United States Patent [19]

Jewell

[11] Patent Number: 4,870,385

[45] Date of Patent: Sep. 26, 1989

[54] HIGH SWITCHING SPEED, COAXIAL SWITCH FOR R.F. SIGNALS

[75] Inventor: Michael B. Jewell, Spokane, Wash.

[73] Assignee: Hewlett-Packard Company, Palo Alto, Calif.

[21] Appl. No.: 205,270

[22] Filed: Jun. 10, 1988

[51] Int. Cl.[4] ..... H01H 53/01

[52] U.S. Cl. ..... 335/5; 335/4

[58] Field of Search ..... 335/5, 4; 333/258, 262

[56] References Cited

U.S. PATENT DOCUMENTS 3,560,897 2/1971 Steinback ..... 335/5

*Primary Examiner*—H. Broome

*Attorney, Agent, or Firm*—Leslie G. Murray

[57] ABSTRACT

A coaxial switch assembly includes a conventional reed switch (10) having a somewhat irregular enclosure (11) and protruding leads (20, 21). R.F. connectors (24, 25) are mounted at the ends of the leads, which are surrounded by predetermined lengths of dielectric tubular material (23). Electrically conductive flowable material (39) is injected within a surrounded shell (36) to fill the space remaining in a shell aperture (37) to rigidify the assembly and provide a continuous coaxial electrical conductor joining the outer body (27, 31) of the R.F. connectors to one another.

10 Claims, 4 Drawing Sheets

HIGH SWITCHING SPEED, COAXIAL SWITCH FOR R.F. SIGNALS

TECHNICAL FIELD

This disclosure relates to improvements in a replay for switching Radio Frequency (R.F.) signals in very short time periods. The resulting switch or reply might be used in circuits such as a areverse power protection scheme for a R.F. signal generator. In this example, the last compoennt in the output signal path must be a switch or relay capable of opening the signal path very quickly in the event that a user inadvertently applies a high power energy source to the output of the instrument, which would otherwise damage delicate internal circuit components. A further requirement of such a protective switch, since the output signal of the instrument must pass through the switch under normal conditions, is that the switch or relay must also have very good R.F. performance when closed.

BACKGROUND ART

Small reed switches are used for applications where R.F. signals must be switched on or off in very short time periods. They typically consist of ferromagnetic contacts that are hermeticallys ealed in a glass vial or enclosure and are selectively activated by the magnetic field resulting from curent flow in a coil wound around the enclosure. A prior art application of a reed switch is illustrated in FIG. 1, which s a sectional view cut through the switch assembly as mounted on a conventional circuit board. The reed switch 10 can be made into a coaxial sltructure by surrounding the glass vial or enclosure 11 of the switch with an electrically conductive and nonferromagnetic tube 14 that acts as the outer conductor of a coaxial transmission line including switch 10. Because of their small size, and the tight tolerance space between the two contacts provided within such a reed switch 10, these switches can be made to open and close very quickly. In the example shown in FIG. 1, the reed switch 10 is surrounded by a nonmagnetic bobbin 12 haing an actuating coil 13 wrapped about it. Switch 10 is arranged parallel to the plane of the printed circuit board 15 and is located within an aperture cut out through the printed circuit board to receive the switch and surrounding bobbin. The leads 20 and 21 of reed switch 10 are directly joined to conductive transmission lines 16 on one side of the printed circuit board. The surrounding conductive tube 14 can be electrically connected to the ground plane 22 on the remaining side of the printed circuit board by short conductors 17.

The main limitation encountered with respect to prior art use of reed relays in the manner shown in FIG. 1 is the impedance mismatches which occur at the ends of the reed switch 10 when mounted in the signal path on the printed circuit board. Because of manufacturing tolerances, there are always nominal gaps at the ends of the vial or enclosure 11 between its coaxial structure and the transmission lines 16 on the printed circuit board 15 (gaps 18 in FIG. 1). These gaps create an impedance mismatch which is random in nature and difficult to correct. In addition, since the diameter of the glass enclosure 11 is generally reduced at the ends of the reed switch 10 becaues it is melted during manufacture of the switch assembly, and since the conductive surrounding tube 14 cannot easily conform to this irregular and somewhat unpredictable enclosure shape, there is a further impedance mismatch introduced because of these gaps (gaps 19 in FIG. 1). The problem becomes more pronounced at higher frequencies, making the approach shown in FIG. 1 not practical for signals substantially above 2 GHz.

The present invention was designed to substantially eliminate both described sources of impedance mismatch inherent in past applications of reed relays to printed circuit board applications, thereby permitting the utilization of the reed relay technology for fast switching applications at much higher R.F. frequencies. The invention also permits the relay builta bou the reed switch technology to be manufactured as a complete, stand-alone component, not dependent upon the charcteristics of a printed circuit board or specific mounting details for its performance specifications.

DISCLOSURE OF INVENTION

The switch assembly comprises a switch having an electrically insulative tubular enclosure centered along an axis, with a pair of leads of predetermined length projecting outwardly from opposed ends of the enclosure. A pair of R.F. connectors each include a center contact mounted within an outer body of electrically conductive material, with each center contact being joined to the outer end of one of the leads at locations axially spaced from the switch casing. Tubular dielectric means of predetermined length abut the respective ends of the switch enclosure and and substantially cover the length of each lead extending between the enclosure and the center contact joined to it. A shell of electrically insulative material is arranged about the switch. The shell has an aperture formed through it that coaxially surrounds and is spaced radially from the switch and dielectric means. The assembly is completed by an electrically conductive mass that fills the remaining space within the aperture and forms a continuous coaxial electrical conductor joining the outer bodies of the R.F. connectors to one another.

The described method of preparing an axial reed switch for insertion and use within a R.F. signal path in an electronic circuit is generally applicable to reed switches having a pair of movable ferromagnetic contacts located within an enclosure centered along an axis and having opposed sealed axial ends that support outwardly projecting leads. The method involves the following steps: partially covering each lead with a length of dielectric tubular material; mounting a coaxial R.F. connector to each lead by joining the center contact of the connector to the outer end of the lead; placing an electrically insulating shell abou the switch by locating the switch within an aperture formed through the shell which surrounds the switch and is radially spaced outwardly from the switch and adjacent dielectric material; injecting a mass of curable electrically conductive liquid into the space remaining in the shell aperture; and curing the mass of liquid to a solid state to phycially integrate the switch, dielectric material, shell and R.F. connectors by forming a coaxial electrical conductor linking the outer bodies of the two R.F. connectors. A magnetic coil is subsequently wrapped about a cylindrical surface on the shell to serve as a control member for the reed switch during its use.

BRIEF DESCRIPTION OF DRAWINGS

FIG. 1 is a cross-sectional view through a typical prior art appliclation of a reed switch relay mounted on a printed circuit board structure;

BEST MODE FOR CARRYING OUT THE INVENTION

Figure 3:
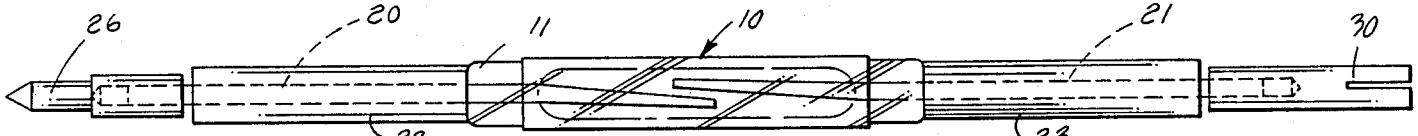
FIG. 3 is a plan view of the partially constructed switch asesmbly.
Figure 4:
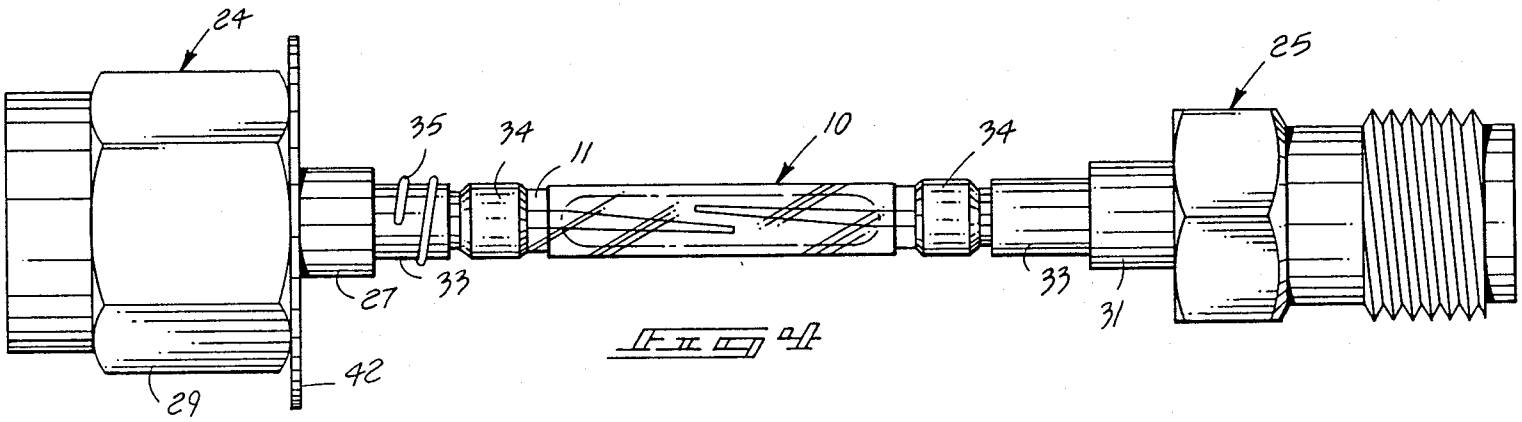
FIG. 4 is a plan view of the switch assembly after further construction.
Figure 5:
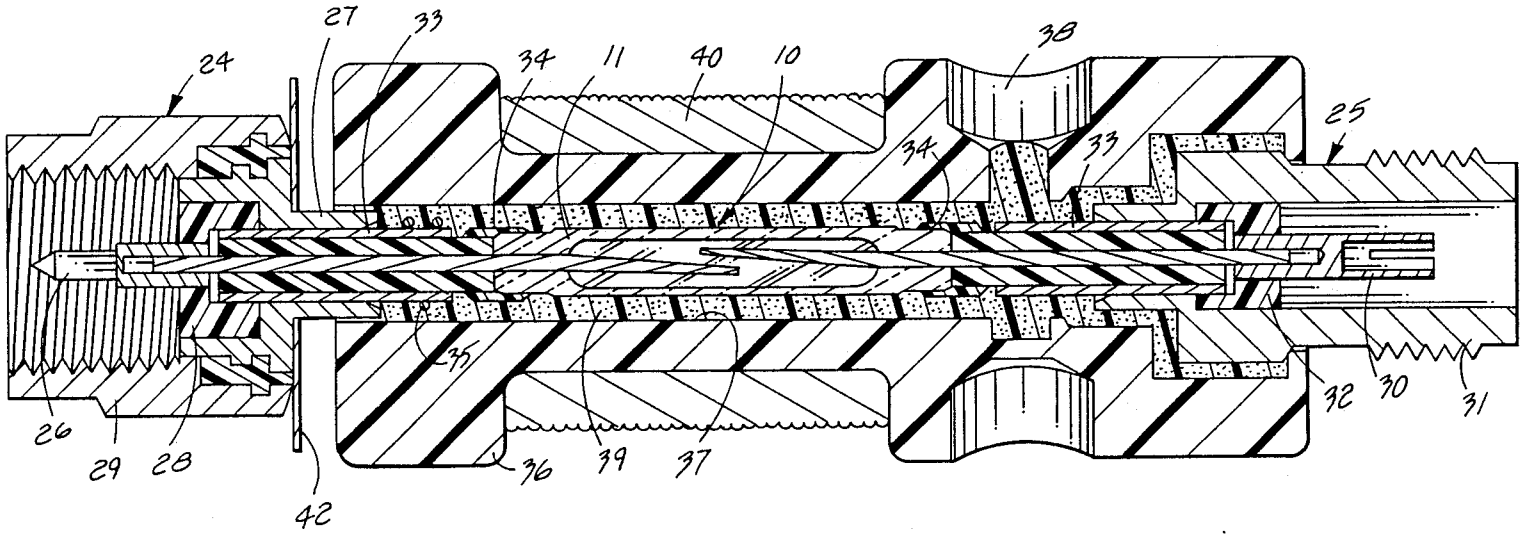
FIG. 5 is a sectional view through the center of the switch assembly as indicated by line 5—5 in FIG. 2, showing the completed assembly.

The improved switch or relay assembly constructed according to this invention can best be understood by detailing its steps of construction as shown progressively in FIGS. 3–5. It incorporates a conventional reed switch 10 of the type described with regard to the prior art illustration in FIG. 1. In this application, the leads 20 and 21 are trimmed to a predetermined length and are partially covered by a length of dielectric tubular material 23. Each length of dielectric tubular material also has a predetermiend length and surrounds the lead in surface-to-surface engagement.

The inner end of each length of dielectric tubular material 23 physically abuts the end of switch enclosure 11 from which the lead within it is projected. One source of the length of dielectric tubular material is the typical Teflon(TM) dielectric utilized in semirigid coaxial cable, which can be separated from the center conductor and outer tube of such cable for utilization in this assembly. The dielectric tubular material 23 can also be produced independently of any other application for the specific purpose of utilizing it within the present switch assembly.

Referring first to FIG. 3, coaxial R.F. connectors 24 and 25 are mounted to the respective outer ends of leads 20 and 21. The connectors 24 and 25 are preferably of complementary male and female construction, but could be identical construction if desired. Any conventional R.F. connectors of suitable size can be utilized.

A typical male R.F. connectors 24 includes a center contact 26 and a coaxial outer body 27 that supports the center contact 26 by an interposed insulator 28 (FIG. 5). The outer body 27 includes an internally threaded cover 29 that is free to rotate relative to the remainder of the outer body to rigidly join the R.F. connector 24 to a complementary female R.F. connector 25.

A typical female R.F. connector 25 includes an apertured center contact 30 mounted within an outer body 31 that coaxially supports the center contact 30 by means of an interposed insulator 32. The outer body 31 is elongated in comparison to the outer body 27 of the male R.F. connector 24, since it includes an exterior threaded section in addition to the hexagonal exterior section used to facilitate the threaded attachment of R.F. connector 25 to the complementary male R.F. connector 24. The physical details of this type of R.F. connector are well-known and need not be further detailed here in order to facilitate an understanding of their application to the present invention.

The initial constructionn of the present switch assembly, as shown in FIG. 3, is completed by soldering the removed center contacts 26 and 30 to the outer ends of the switch leads 20 and 21, respectively. Because the leads 20 and 21 have a known predetermiend length, as do the lengths of dielectric tubular material 23, one can design the assembly to include a predetermined gap of known length as might be required between each center contact 26, 30 and the adjacent end of each length of dielectric tubular material 23. The impedance resulting from these gaps will be uniform and predictable.

As shown in FIG. 4, the outer bodies 27 and 31 of the respective R.F. connectors 24 and 25 are soldered to short lengths of tubular electrically conductive material that surround an outer section of each length of dielectric tubular material 23. The conductive tubing 33 can be made from the solid copper tube that comprises the outer conductor in semirigid coaxial cable, or it can be a conductive tube fabricated expressly for incorporation within the present switch assembly. each length of tubing 33 preferably extends inwardly from the R.F. connector 24 or 25 that surrounds it.

The subassembly showon in FIG. 4 is completed by sealing the joint formed between each end of enclosure 11 and the length of dielectric tubular material 23 that abuts it. As shown, the sealing material is merely a nonconductive adhesive (Elmer's(TM) glue) that fills any crack or irregularity to assure that no gap exists between the enclosure 11 and the adjacent end of the dielectric material. The adhesive 34 temporarily keeps the lengths of dielectric material in abutting positions against the opposed ends of enclosure 11 and also assures against short-circuiting the switch assembly during the subsequent formation of the outer coaxial conductor along the switch assembly. Any electrically nonconductive flowable material capable of sealing the circumferential area at each end of enclosure 11 can be utilized for this purpose.

Also shown in FIG. 4 is a wrap of wire 35 arranged about a circumference of tubing 33 adjacent to the male R.F. connector 24. It simply provides a "roughened" surface about the tubing 33 to assure bonding of the outer conductive material at the shorter R.F. connector structure. A washer 42 is preferably provided against the inner end of cover 29 to assure that subsequently injected flowable materials used in the assembly do not interfere with the rotatable mounting of cover 29.

Figure 11:
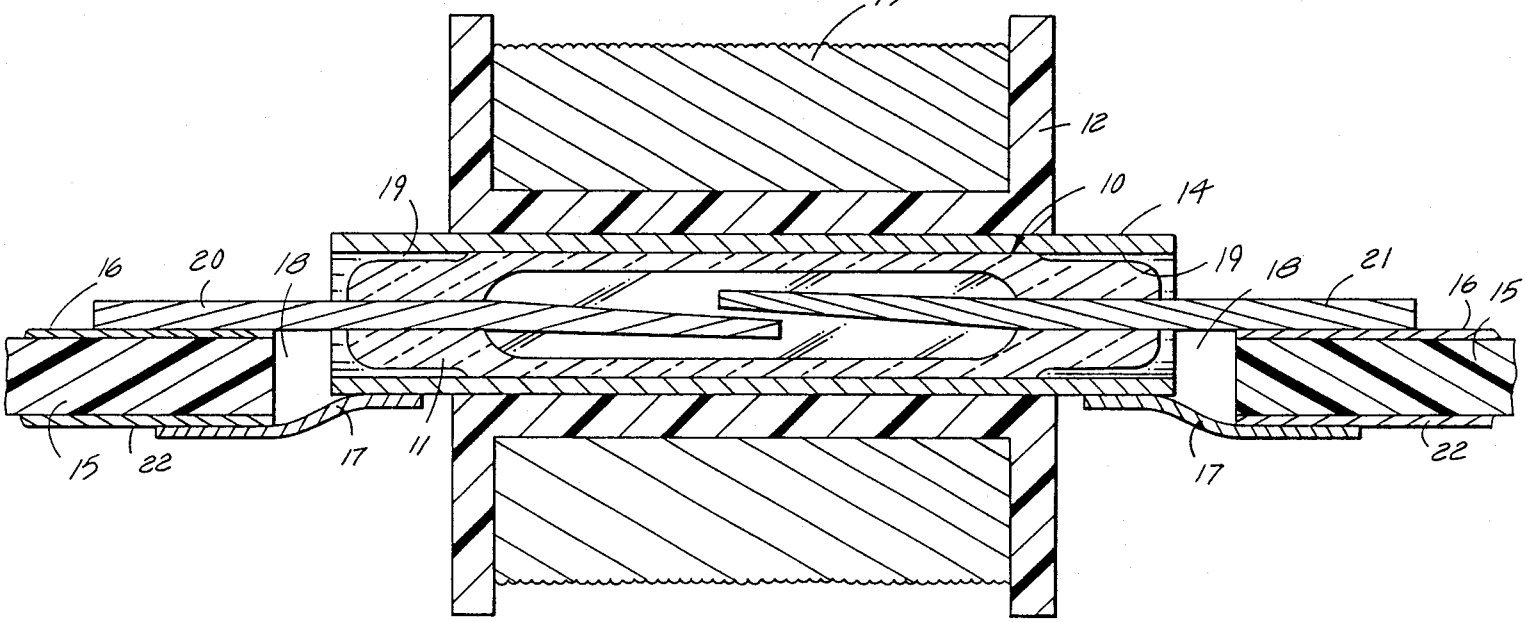
FIG. 11 PRIOR ART
Figure 2:
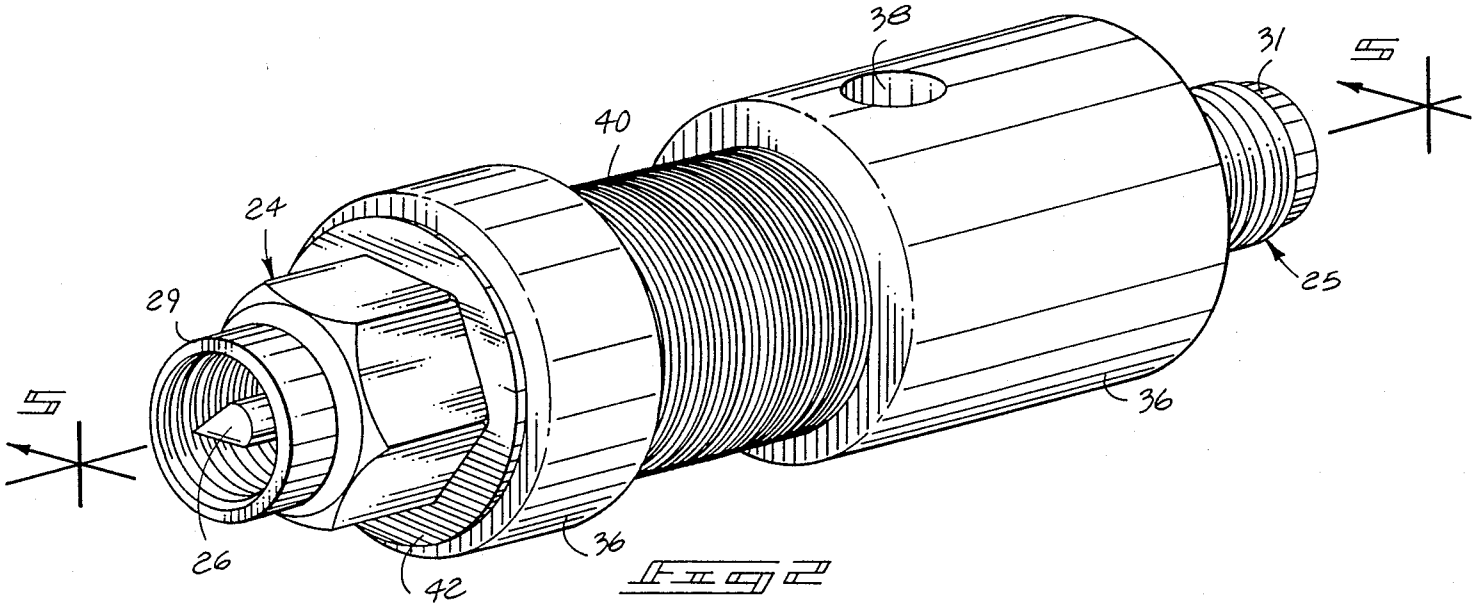
FIG. 2 is an exterior perspective view of the switch assembly according to the present disclosure.

The completed switch assembly can best be understood by reference to FIGS. 2 and 5. A two-piece rigid shell 36 of electrically insulating resin or other material is placed about the subassembly shown in FIG. 4 by locating the reed switch 10 within an aperture 37 formed through the shell 36. Aperture 37 surrounds the reed switch 10 and is radially spaced outwardly from the switch 10 and the adjacent lengths of dielectric tubular material 23. As shown, the axial length of shell 36 overlaps a portion of the outer body 27 of R.F. connector 24 and a portion of the ouer body 31 of R.F. connector 25.

As seen in FIG. 5, shell 36 includes a perpendicular opening 38 through which an electrically conductive resin 39 can be injected into the space remaining in the aperture 37. As an example, the resin 39 might be an electrically conductive epoxy resin, which, upon curing, provides mechanical rigidity by integrating the switch 10, the lengths of dielectrical tubular material 23, the shell 36, and the R.F. connectors 24, 25 and also provides a perfectly conformal outer conductor surrounding the switch assembly. This eliminates the second impedance mismatch indicated by gaps 19 in FIG. 1. The first mismatch that results from gaps 18 as shown in FIG. 1 is eliminated by use of the R.F. connectors 25 and 25 which can be used in conjunction with complementary connectors (not showon) to insert the switch assembly within a desired circuit structure.

Shell 36 also serves as a bobbin for a relay coil 40 (FIG. 5) wound about shell 36 as the last step in the production of the switch assembly. Coil 40 is wound about a cylindrical surface formed coaxially on shell 36 to serve as a control member for selectively activating the reed switch 10 during use of the switch within an electronic circuit.

The invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted to encompass equivalents.

We claim:

1. A coaxial switch assembly for a Radio Frequency (RF) signal path in an electronic circuit, comprising:

a switch having an electrically insulative tubular enclosure centered along an axis, the switch including a pair of electrical leads of predetermined length centered along the axis and projecting outwardly from opposed ends of the enclosure;

a pair of RF connectors each including a center contact mounted within an outer body of electrically conductive material, each center contact being joined to the outer end of a different one of the leads at locations axially spaced from the switch enclosure;

tubular dielectric means of predetermined length abutting the respective ends of the switch enclosure and substantially covering the length of each lead extending between the switch enclosure and the center contact joined to it;

a rigid shell having an aperture formed through it that coaxially surrounds and is radially spaced from the switch enclosure and dielectric means; and an electrically conductive mass within the shell aperture that forms a continuous coaxial electrical conductor joining the outer bodies of the RF connectors to one another.

2. The switch assembly of claim 1 wherein the switch is a reed switch having movable ferromagnetic contacts within the enclosure and wherein the shell is constructed of electrically insulative material and has an exterior cylindrical surface coaxially overlapping the switch; and coil means wrapped about the exterior cylindrical surface of the shell for selectively actuating the ferromagnetic contacts of the reed switch.

3. The switch assembly of claim 1 wherein the end of the dielectric means adjacent each center contact is partially covered by a length of electrically conductive tubular material joined to the outer body of the RF connector associated with the center contact.

4. The switch assembly of claim 1 wherein the end of the dielectric means adjacent each center contact is partially covered by a length of tubular electrically conductive material joined to the outer body of the RF connector associated with the center contact, the length of tubular electrically conductive material being extended along the dielectric means and being directly engaged by the electrically conductive mass within the shell aperture.

5. The switch assembly of claim 1 wherein the electrically conductive mass comprises a molded resin injected into the shell aperture as a liquid and subsequently solified.

6. The switch assembly of claim 1 wherein the shell aperture coaxially overlaps the switch enclosure, the dielectric means and at least a portion of each RF connector, and wherein the electrically conductive mass within the shell aperture directly engages the switch enclosure, the dielectric means and each RF connector to rigidly locate them within the surrounding shell.

7. A coaxial switch assembly for Radio Frequency (RF) signal path in an electronic circuit, comprising;

a reed switch having a pair of movable ferromagnetic contacts located within a glass enclosure centered an axis, the switch enclosure having opposed sealed axial ends that support outwardly projecting coaxial leads of predetermined length extending from the respective contacts;

a pair of RF connectors each including a center contact mounted within an outer body of electrically conductive material, each center contact being joined to the outer end of a different one of the leads at locations axially spaced from the switch enclosure;

a length of tubular dielectric material of predetermined length surrounding each lead in surface-to-surface engagement between the reed switch and the center contact joined to the lead, each length of dielectric material being in axial abutment with the switch enclosure;

a rigid shell having an aperture formed through it that coaxially surrounds and is radially spaced from the switch enclosure and dielectric means; and an injected mass of electrically conductive material solidified within the shell aperture for physically integrating the switch, the length of dielectric material, the shell and the RF connectors as a rigid unit and forming a coaxial electrical conductor filling the space within the aperture and establishing an electrical path between the outer bodies of the RF connectors; and a coaxial electromagnetic coil formed about the exterior of the shell in a position overlapping the reed switch.

8. A method of preparing an axial reed switch for insertion and use within a Radio Frequency (RF) signal path in an electronic circuit, wherein the reed switch has a pair of movable ferromagnetic contacts located within a enclosure centered along an axis and having opposed sealed axial ends that support outwardly projecting leads extending from the respective contacts and centered along the axis, the method comprising the following steps:

partially covering each lead with a length of dielectric tubular material that surrounds it in surface-to-surface engagement and physically abuts the end of the switch enclosure from which the lead is projected;

mounting a coaxial RF connector including a center contact and a coaxial insulated outer body to each lead by joining the center contact to the outer end of the lead;

placing a shell of electrically insulating material about the reed switch by locating it within an aperture formed through the shell which surrounds it and is radially spaced outwardly from the switch and adjacent lengths of dielectric tubular material;

injecting a mass of curable electrically conductive liquid into the space remaining in the shell aperture; and curing the mass of liquid to a solid state wherein it physically integrates the switch, the length of dielectric material, the shell and the RF connectors by forming a coaxial electrical conductor linking the outer bodies of the respective RF connectors.

9. The method of claim 8 further comprising the following additional step:

partially covering the outer end of each length of dielectric material with a coaxial length of electrically insulating tubular material in surface-to-surface contact with the exterior of the dielectric material and joining the electrically conductive tubing to the body of the adjacent RF connector.

10. The method of claim 8 further comprising the following additional step:

winding a magnetic coil about a cylindrical surface formed coaxially on the shell as a control member for selectively activating the reed switch during its subsequent usage within an electronic circuit.

* * * * *

UNITED STATES PATENT AND TRADEMARK OFFICE

CERTIFICATE OF CORRECTION

PATENT NO. : 4,870,385

DATED : September 26, 1989

INVENTOR(S) : Michael B. Jewell

It is certified that error appears in the above-identified patent and that said Letters Patent is hereby corrected as shown below:

Column 1, line 6, "replay" should read --relay--.

Column 1, line 8, "reply" should read --relay--.

Column 4, line 17, "each" should read --Each--.

Column 4, line 55, "ouer" should read --outer--.

Column 5, line 3, "showon" should read --shown--.

Column 6, line 6, "solified" should read --solidified--.

Column 6, line 18, "opposied" should read --opposed--.

Signed and Sealed this

Third Day of November, 1992

*Attest:*

*Attesting Officer*

DOUGLAS B. COMER

*Acting Commissioner of Patents and Trademarks*